US007534129B2

(12) United States Patent
Boldy

(10) Patent No.: US 7,534,129 B2
(45) Date of Patent: May 19, 2009

(54) DEVICE AND METHOD FOR IDENTIFYING CABLES

(75) Inventor: Manfred Boldy, Horb a.N. (DE)

(73) Assignee: International Business Machines Corporation, Armonk, NY (US)

( * ) Notice: Subject to any disclaimer, the term of this patent is extended or adjusted under 35 U.S.C. 154(b) by 0 days.

(21) Appl. No.: 11/465,267

(22) Filed: Aug. 17, 2006

(65) Prior Publication Data

US 2006/0276074 A1 Dec. 7, 2006

Related U.S. Application Data

(63) Continuation of application No. 10/043,925, filed on Oct. 23, 2001, now Pat. No. 7,134,200.

(30) Foreign Application Priority Data

Nov. 1, 2000 (EP) ..... 00123771

(51) Int. Cl.
*H01R 3/00* (2006.01)

(52) U.S. Cl. ..... 439/491

(58) Field of Classification Search ..... 439/491
See application file for complete search history.

(56) References Cited

U.S. PATENT DOCUMENTS

| | | | | |
|---|---|---|---|---|
| 2,629,953 | A | 2/1953 | Stackelberg et al. | |
| 3,212,207 | A | 10/1965 | Searing | |
| 3,297,618 | A | 1/1967 | Waddington | |
| 3,474,559 | A * | 10/1969 | Hunt | 40/316 |
| 3,551,542 | A | 12/1970 | Perrone | |
| 3,571,781 | A | 3/1971 | Gartland et al. | |
| 3,638,169 | A | 1/1972 | Cavenet et al. | |
| 3,792,417 | A | 2/1974 | Punako | |
| 3,930,710 | A | 1/1976 | Sollanek | |
| 3,995,888 | A | 12/1976 | Mcilroy | |
| 4,275,768 | A | 6/1981 | Riggs et al. | |
| 4,445,750 | A | 5/1984 | Grois et al. | |
| 4,448,481 | A | 5/1984 | Basov et al. | |
| 4,449,784 | A | 5/1984 | Basov et al. | |
| 4,579,759 | A | 4/1986 | Breuers | |
| 4,718,861 | A | 1/1988 | Wood | |
| 4,923,274 | A | 5/1990 | Dean | |
| 4,997,994 | A | 3/1991 | Andrews et al. | |
| 5,117,570 | A | 6/1992 | Moronsini | |
| 5,470,253 | A | 11/1995 | Siems et al. | |

(Continued)

FOREIGN PATENT DOCUMENTS

| | | |
|---|---|---|
| EP | 1168017 | 1/2002 |

(Continued)

*Primary Examiner*—Truc T Nguyen
(74) *Attorney, Agent, or Firm*—William H. Steinberg; Greenblum & Bernstein P.L.C.

(57) ABSTRACT

In a strain relief clamp for use with a connector that is mounted on an end of a cable. The cable is provided with identification markings. The cable may be cut to length so that one of the identification markings which is a marking of interest appears directly behind a shell of the connector when the connector is mounted on the cable. The strain relief clamp includes a window through which the marking of interest on the cable is visible when the strain relief clamp is installed on the connector and a transparent member arranged on the window.

4 Claims, 3 Drawing Sheets

U.S. PATENT DOCUMENTS 5,489,275 A * 2/1996 Thompson et al. ..... 604/264
5,548,871 A 8/1996 Trethewey
5,620,335 A * 4/1997 Siemon ..... 439/491
5,645,534 A 7/1997 Chanoch
5,742,982 A 4/1998 Dodd et al.
5,780,775 A * 7/1998 Yu ..... 174/135
5,862,774 A 1/1999 Moss
6,039,600 A 3/2000 Etters et al.
6,042,562 A 3/2000 Amor
6,077,124 A 6/2000 Etters et al.
6,250,817 B1 6/2001 Lampert et al.
6,328,731 B1 12/2001 Ouchi
6,367,987 B1 4/2002 Beier et al.
6,394,662 B1 5/2002 Foster
6,420,657 B1 * 7/2002 Fang et al. ..... 174/112
6,421,495 B1 7/2002 Hoffmeister et al.
6,434,315 B1 8/2002 Grois et al.
6,484,628 B2 11/2002 Otani et al.
6,517,253 B1 2/2003 Graesser
6,623,173 B1 9/2003 Grois et al.
6,777,618 B2 8/2004 Bond et al.

FOREIGN PATENT DOCUMENTS

GB 2184615 6/1987
JP 5 9042504 3/1984

* cited by examiner

DEVICE AND METHOD FOR IDENTIFYING CABLES

CROSS-REFERENCE TO RELATED APPLICATIONS

The present application is a continuation of parent U.S. patent application Ser. No. 10/043,925, filed on Oct. 23, 2001, the disclosure of which is expressly incorporated by reference herein in its entirety. Further, the present application claims priority under 35U.S.C. § 119 of European Patent Application No. 00123771.8 filed on Nov. 1, 2000, the disclosure of which is hereby incorporated by reference herein in its entirety.

FIELD OF THE INVENTION

The present invention relates to a device for identification marking of cables. In particular, the invention concerns cables that are provided with unambiguous markings at least in their end sections. The invention also relates to a method for identification marking of cables.

BACKGROUND OF THE INVENTION

In the last few years, the amount of cable in use has increased significantly. Especially in the area of computers and telecommunication devices, there has been a large increase due to the development of new devices and technologies such as new telephone systems, local area networks, and so forth.

These systems often need miles of electric cable in order to interconnect devices located far apart. Such cables are needed to connect, for example, a master control unit, such as a switch or a telephone system, with outlets or the like spread over one or more buildings of a large campus.

Frequently, racks carrying hundreds of connectors are arranged in a single room. In order to be able to find a particular connector within this jumble, the cable ends are normally marked. If this is not the case, a cable must be trailed from one end to the other, which is generally very cumbersome.

For marking cables, the following methods are used today: Installation of marking rings carrying letters or numbers; Installation of a labeled heat-shrinkable sleeve; and Fastening of plastic slips.

U.S. Pat. No. 4,579,759discloses the use of an inscribable cable marking strip comprising a strip of an adhesive tape having a self-adhering bottom side and carrying an inscribable marking section. The beginning of the inscribable marking section is located at a distance from the adjacent front end of the adhesive tape to define an unlettered, transparent starting section of the strip which may be pressed onto the cable without soiling the marking section or smudging the lettering applied to it.

Several other cable marking systems are known, for instance using codes preprinted on the sleeve or printed on labels glued onto the sleeve, and the like. A cable marking system is also known wherein ring-shaped marking elements are introduced in a recess on the outside of the support.

However, such systems have the disadvantage that they are either very costly or time consuming, or that tapes, rings, and the like may slip or fall off, so that the marking is no longer discernible.

Therefore, it has been proposed to mark the cable itself. For example, U.S. Pat. No. 4,370,542 describes a method for marking an identification at pre-selected intervals along a length of cable by a laser marking device. However, it is still difficult to find such a marked cable when mounted to a connector and arranged among a multitude of other cables.

It is therefore an object of the present invention to provide a device for identification marking of cables that is easy to handle and allows easy location of a particular cable among others.

It is still another object of the present invention to provide a method for identification marking of such cables that allows marking without the use of additional equipment.

SUMMARY OF THE INVENTION

According to the present invention, an improved strain relief clamp for a connector mounted on a cable includes a transparent portion such as a rectangular window or a transparent ring held in a groove. The cable, which is provided with unambiguous identification markings at its end region, is cut to length so that an identification marking of interest appears directly behind the connector's shell when the connector is mounted on the cable. When the strain relief clamp is installed on the connector, the identification marking of interest is visible through the transparent portion of the strain relief clamp.

BRIEF DESCRIPTION OF THE DRAWINGS

The invention will hereinafter be described in more detail in connection with the accompanying drawings, in which FIG. 1 schematically shows a cable that is provided with unambiguous markings at least in its end section.

DETAILED DESCRIPTION OF THE INVENTION

The present invention is not restricted to electric cables, but can be used with every kind of cable provided with a strain relief clamp, regardless of whether it carries electricity, fluids, gases, air, or other media. Thus, the invention may be applied to every form of cable, including round, tubular, flat, or rectangular cables. However, the invention is described below with respect to an electric cable only for clarity.

Figure 1:
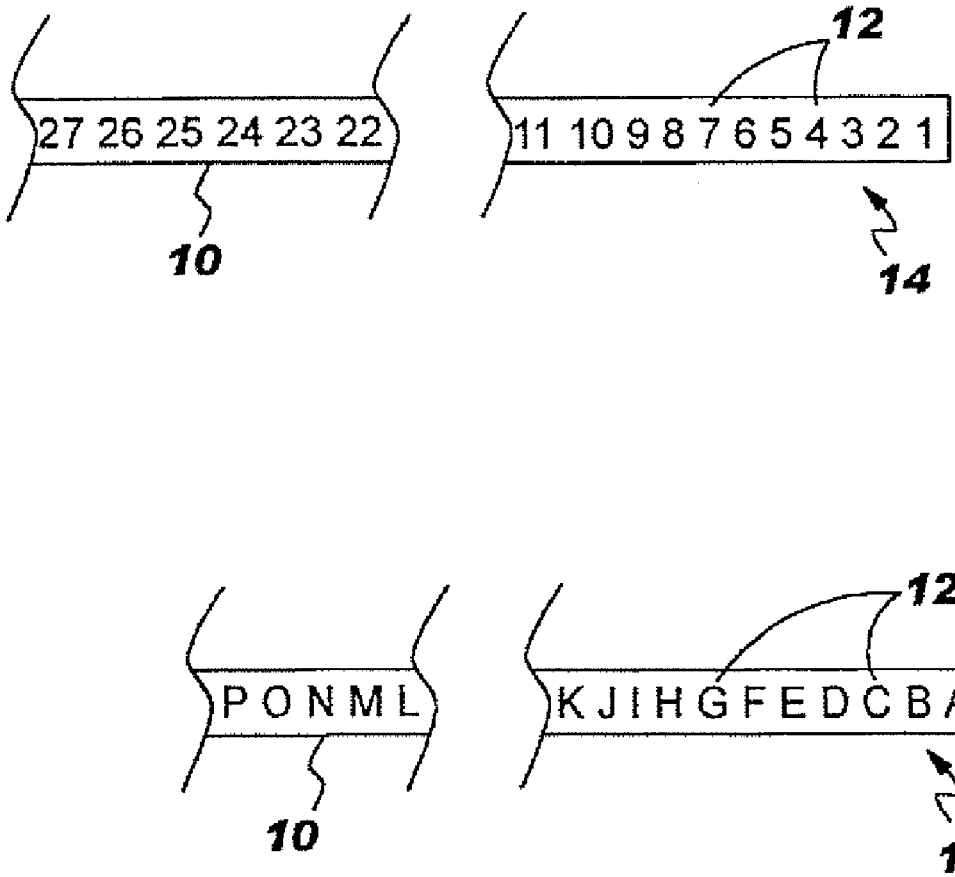

As shown in FIG. 1, a cable 10 is marked with unambiguous identification markings 12 at least in its end sections 14. This can be done by applying numbers or letters or combinations thereof by means of color printing or laser marking. The number of positions is restricted due to limitations of the area of the cable. Consequently, it is sensible to use numbers or letters having two digits. These markings may be repeated on the whole cable within regular or irregular intervals. It is, however, necessary that these markings be unambiguous, i.e., they must unequivocally identify a particular cable or part thereof.

The cable 10 thus marked is cut such that the marking of interest 16, i.e., the marking that is to define the respective cable or part thereof, is visible directly behind the shell of a connector 18 when the connector 18 is mounted to the cable 10. This is shown in FIG. 2.

The connector 18 may be an RG45 or Western connector or an RJ connector. However, other connectors are suitable as well, and the invention is not restricted to these connectors. The connector 18 shown in FIG. 2 may be provided with a safety hook 20 which serves to lock the connector in place.

Figure 2:
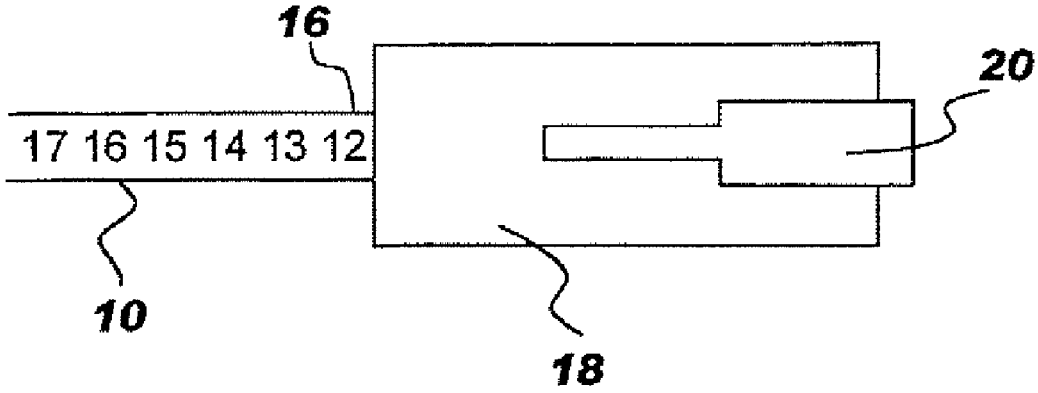
FIG. 2 schematically depicts the cable of FIG. 1 that is connected to a connector.
Figure 3A:
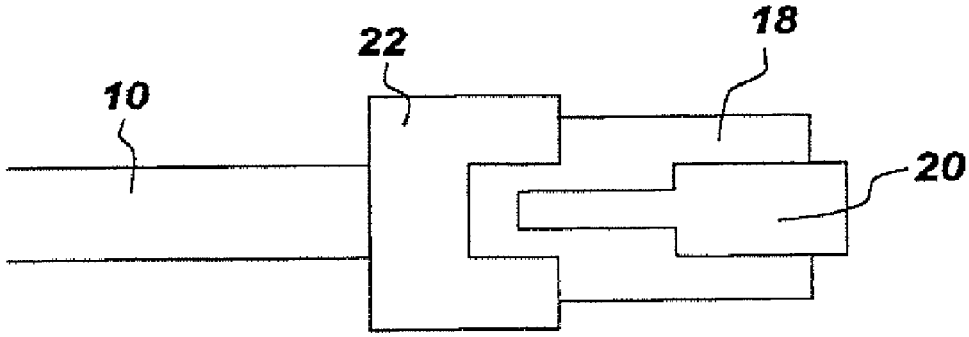
FIGS. 3A to 3C schematically show the cable of FIG. 2 in connection with a respective strain relief clamp.
Figure 3B:
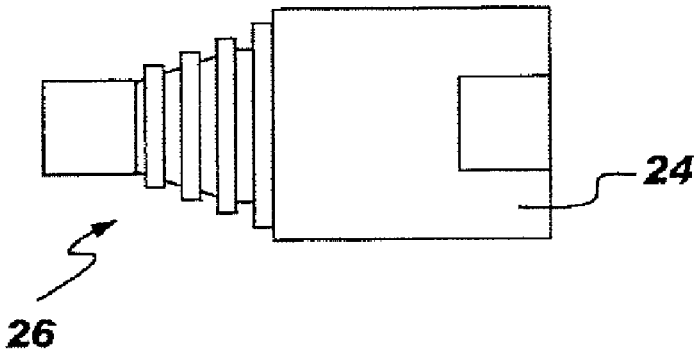

FIG. 3A shows the arrangement of FIG. 2 where a metal grounding 22 has been added to the connector 18.

Figure 3C:
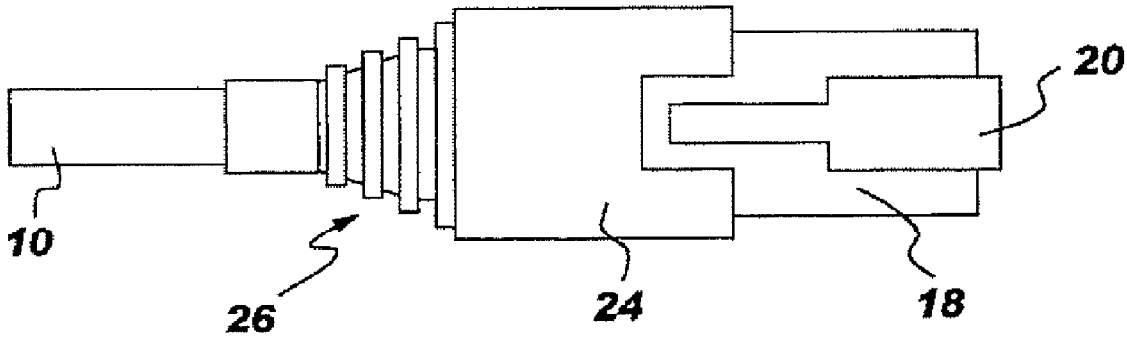

A strain relief clamp 24, which may be put on the cable 10 before mounting the connector 18, is now installed on the connector 18 as shown in FIG. 3C. The strain relief clamp 24 may at the same time function as an antikink protective sleeve by means of an antikink component 26.

Figure 4A:
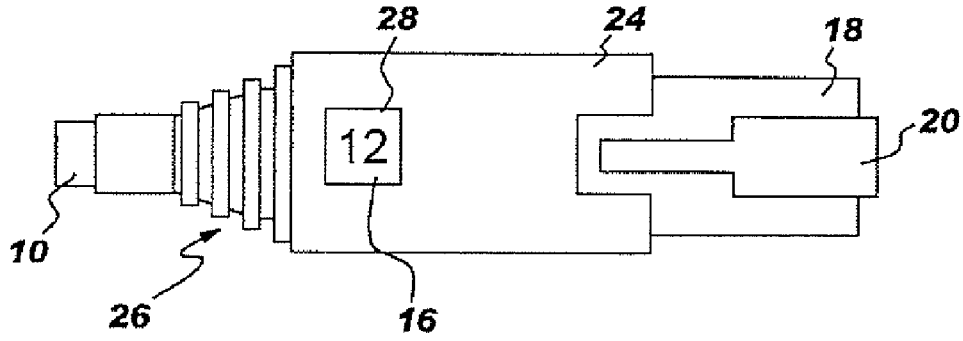
FIGS. 4A to 4C schematically depict several embodiments of the device according to the invention.
Figure 4B:
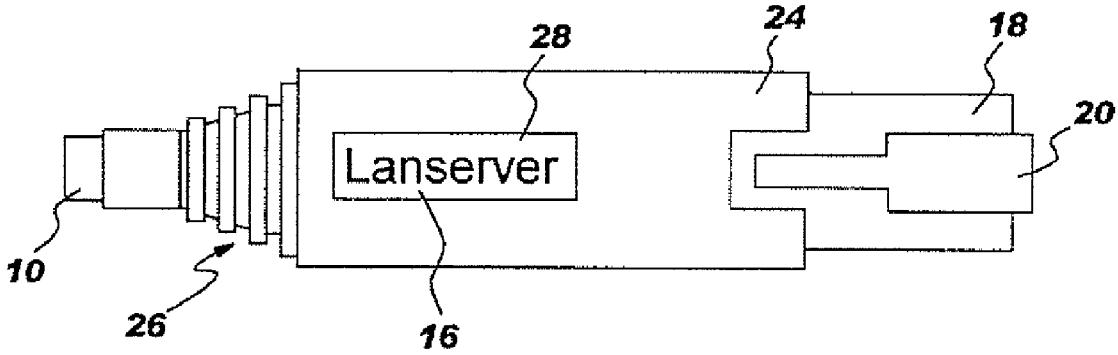

According to the invention, the strain relief clamp 24 is provided with a transparent portion for making visible the marking of interest 16 present on the cable 10 after the strain relief clamp 24 has been installed on the connector 18. The transparent portion may be a rectangular window 28, through which the marking of interest is readable, as shown in FIG. 4A. In case the marking of interest includes a long row of digits or letters (represented by the word "LANSERVER" in FIG. 4B), the strain relief clamp 24 and thus the window 28 may be elongated so that even long words may be read.

Figure 4C:
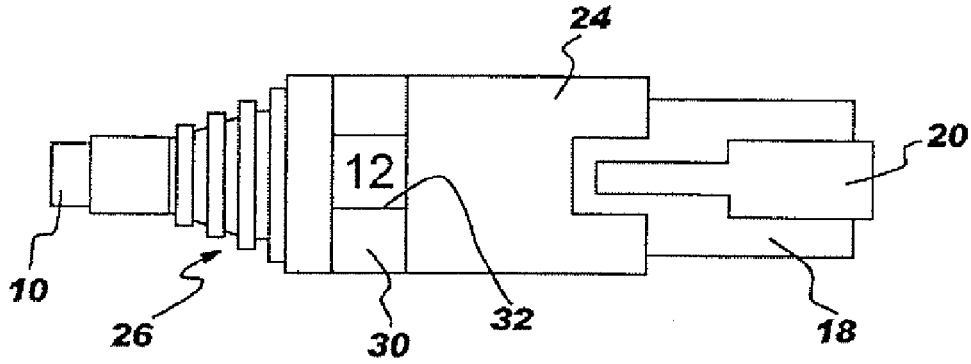

FIG. 4C represents another embodiment of the invention. Here, the transparent portion is a transparent ring 30 that is arranged around the strain relief clamp 24. The ring 30 preferably extends 360 degrees around the clamp 24 and may be either tightly connected to the clamp 24 or movably guided within a groove 32 present in the clamp. In another advantageous embodiment, only the part of the ring 30 above the marking is transparent, whereas the rest is made of a substantially opaque material.

Of course it is possible and advantageous to provide the cable 10 with the inventive strain relief clamp 24 at both ends thereof.

Another advantageous embodiment of the present invention provides for an additional colored marking at one or both ends of the cable 10.

With the device according to the invention it is possible to easily and quickly detect an identification marking on the respective end portions of a particular cable, even if the cable is bunched together with other cables. Thus, fault analysis is simplified and cable problems can now more easily be solved.

Still another advantage of the present invention concerns marked, prefabricated cables of the type known as patch cables. The manufacturer of such patch cables may use a lasermarker to produce as many patch cables as needed. The cable can be produced according to known procedures and can then be marked without additional effort.

What is claimed:

1. A combination comprising:

an electrical cable comprising, at least in end sections of the electrical cable, identification markings applied to the electrical cable by printing or laser marking;

a connector mounted on an end of the electrical cable; and a strain relief clamp arranged behind and on a rear end of the connector and comprising a window through which a marking of interest of the identification markings of the electrical cable is visible.

2. The combination of claim 1, wherein the identification markings are repeated on the cable within regular or irregular intervals.

3. The combination of claim 1, further comprising a ring surrounding a circumference of the strain relief clamp, wherein the ring comprises a transparent portion.

4. A combination comprising:

an electrical cable comprising, at least in end sections of the electrical cable, identification markings applied to the electrical cable by printing or laser marking;

a connector mounted on an end of the electrical cable; and a strain relief clamp arranged behind the connector and comprising a window through which a marking of interest of the identification markings of the electrical cable is visible, wherein the strain relief clamp comprises a groove that receives therein the ring.

* * * * *